US009116487B2

(12) United States Patent
Tosaka et al.

(10) Patent No.: US 9,116,487 B2
(45) Date of Patent: Aug. 25, 2015

(54) IMAGE FORMING APPARATUS

(71) Applicants: Akihiko Tosaka, Kanagawa (JP); Toshiyuki Uchida, Kanagawa (JP); Kazuhiro Kobayashi, Kanagawa (JP); Hiroaki Murakami, Kanagawa (JP)

(72) Inventors: Akihiko Tosaka, Kanagawa (JP); Toshiyuki Uchida, Kanagawa (JP); Kazuhiro Kobayashi, Kanagawa (JP); Hiroaki Murakami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/541,896

(22) Filed: Nov. 14, 2014

(65) Prior Publication Data

US 2015/0147099 A1 May 28, 2015

(30) Foreign Application Priority Data

Nov. 28, 2013 (JP) ..... 2013-246628

(51) Int. Cl.
*G03G 15/00* (2006.01)

(52) U.S. Cl.
CPC ..... *G03G 15/5058* (2013.01)

(58) Field of Classification Search
CPC ..... G03G 15/5041; G03G 15/5058; G03G 2215/0158; G03G 2215/0161
See application file for complete search history.

(56) References Cited

U.S. PATENT DOCUMENTS

| | | | | |
|---|---|---|---|---|
| 2006/0222418 | A1 | 10/2006 | Ebara et al. | |
| 2007/0212109 | A1 | 9/2007 | Ebara et al. | |
| 2008/0166153 | A1 | 7/2008 | Ehara et al. | |
| 2012/0251150 | A1* | 10/2012 | Nara et al. | 399/66 |
| 2015/0086239 | A1* | 3/2015 | Inuzuka | 399/121 |

FOREIGN PATENT DOCUMENTS

| | | |
|---|---|---|
| JP | 2009-288376 | 12/2009 |
| JP | 2011-242469 | 12/2011 |
| JP | 2013-109072 | 6/2013 |

* cited by examiner

*Primary Examiner* — Gregory H Curran
(74) *Attorney, Agent, or Firm* — Oblon, McClelland, Maier & Neustadt, L.L.P.

(57) ABSTRACT

An image forming apparatus includes an image bearing member, a plurality of developing devices, a transfer device, a moving device, a color drift detector, a test pattern forming device, and a color drift correction device. The test pattern forming device forms a test pattern on the image bearing member. The color drift correction device corrects the color drift in a separating state in which the image bearing member and the transfer device are separated from each other. The test pattern forming device forms the test pattern again in an area on the image bearing member contacting the transfer device but not pressed by the transfer device after the color drift correction device corrects the color drift in the separating state, and the color drift correction device corrects the color drift in the contact state in which the image bearing member and the transfer device are in contact with each other.

6 Claims, 8 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2013-246628, filed on Nov. 28, 2013, in the Japan Patent Office, the entire disclosure of which is hereby incorporated by reference herein.

BACKGROUND

1. Technical Field

Exemplary aspects of the present disclosure generally relate to an image forming apparatus, and more particularly to an image forming apparatus such as a copier, a facsimile machine, a printer, a plotter or a multi-functional system including a combination thereof.

2. Description of the Related Art

Generally, known tandem-type color image forming apparatuses adjust color drift by forming on an intermediate transfer belt a test pattern for detecting the color drift in each color and detecting the position of the test pattern by a reflective-type photosensor or the like. Based on the detection result of the photosensor, an amount of color drift in each component such as registration, magnification, and skew is calculated. In accordance with the calculation result thus obtained, an optical path of an optical system, a start position of image writing for each color, and a pixel clock frequency are corrected. In order to increase detection accuracy, for example, the test patterns are formed at a plurality of transfer positions, for example, at the center and at both ends of the intermediate transfer belt, and the amount of color drift is calculated.

Generally, in such image forming apparatus, at least one of a pair of secondary transfer rollers (for example, a drive roller and a secondary transfer roller) employs an elastic roller such as a rubber roller to enhance transferability. In this configuration, the diameter of the roller changes slightly between when the roller is pressed against a recording medium via the intermediate transfer belt during transfer of an image and when the roller is separated such as when the test pattern is formed for the color drift adjustment. When the diameter of the roller changes, the surface speed of the intermediate transfer belt entrained about the drive roller or the like fluctuates, hence resulting in a registration deviation in actual printing.

SUMMARY

In view of the foregoing, in an aspect of this disclosure, there is provided an improved (or novel) image forming apparatus including an image bearing member, a plurality of developing devices, a transfer device, a moving device, a color drift detector, a test pattern forming device, and a color drift correction device. The image bearing member bears a latent image on a surface thereof. The plurality of developing devices is disposed corresponding to the image bearing member to develop latent images formed on the image bearing member with toner in different colors to form toner images in different colors. The transfer device transfers the toner images from the image bearing member onto a recording medium. The moving device moves the transfer device to contact the image bearing member in a contact state and separate from the image bearing member in a separating state. The color drift detector detects color drift of the toner images borne on the image bearing members. The test pattern forming device forms a test pattern on the image bearing member to detect the color drift. The color drift correction device corrects the color drift in the separating state in which the image bearing member and the transfer device are separated from each other. The test pattern forming device forms the test pattern again in an area on the image bearing member contacting the transfer device but not pressed by the transfer device after correction of the color drift by the color drift correction device in the separating state, and the color drift correction device corrects the color drift in the contact state in which the image bearing member and the transfer device are in contact with each other.

In another aspect of this disclosure there is provided a method for correcting color drift. The method includes the steps of separating a transfer device from an image bearing member; writing a first test pattern for detection of color drift in an image region and a non-image region of an image bearing member in a separating state in which the transfer device is separated from the image bearing member; detecting the first test pattern; incorporating a result of the detecting as a first calculation result in settings of registration, magnification, and skew when the first test pattern is detected correctly; moving the transfer device to contact the image bearing member; writing a second test pattern in the non-image region of the image bearing member; detecting the second test pattern; and incorporating a result of the detecting as a second calculation result in the registration and magnification when the second test pattern is detected correctly.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
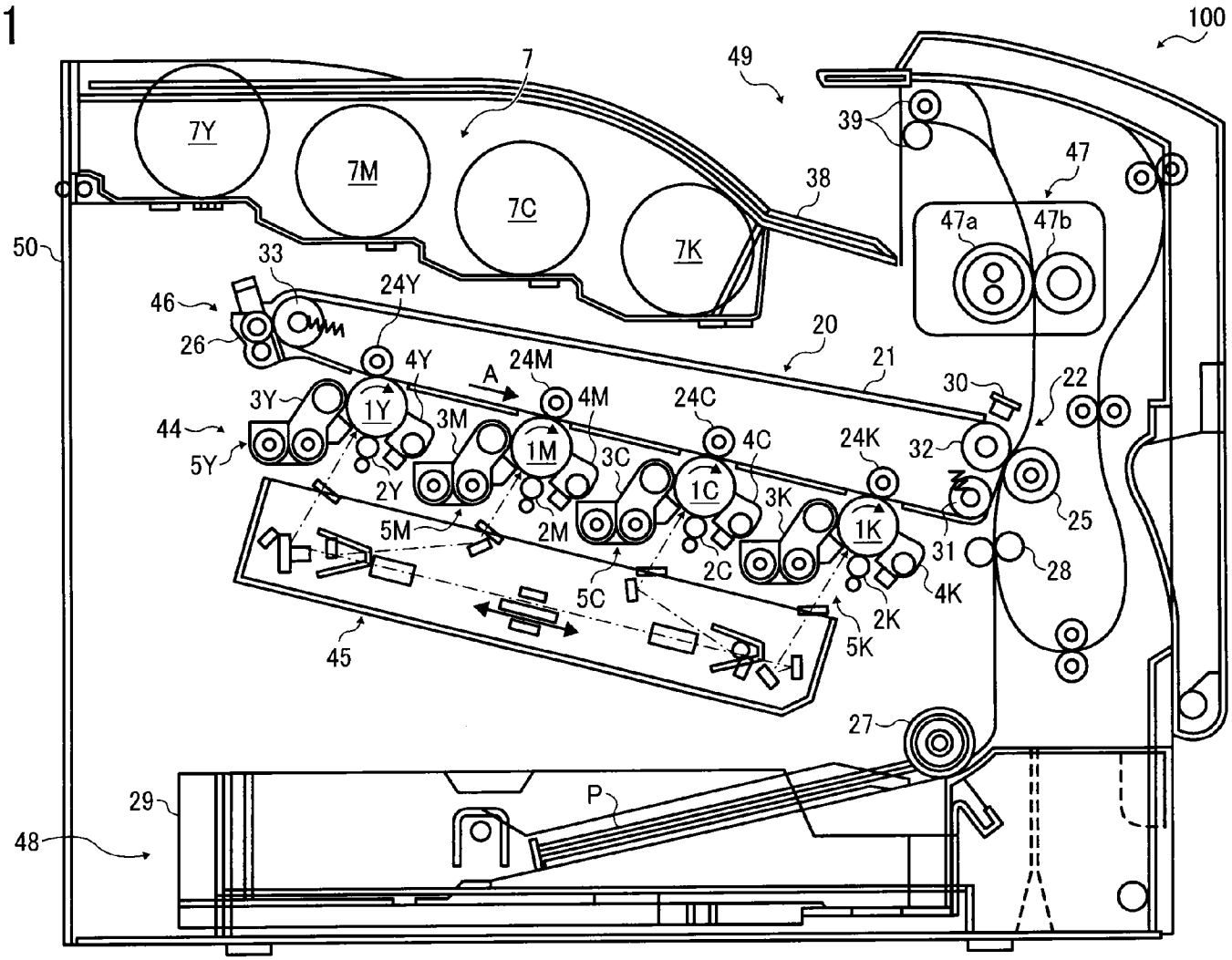
FIG. 1 is a schematic diagram illustrating an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of an image forming apparatus according to an illustrative embodiment of the present disclosure. FIG. 1 illustrates a tandem-type color printer using an intermediate transfer method as an example of an image forming apparatus 100. According to the illustrative embodiment, the image forming apparatus 100 produces a color image by superimposing four color components, yellow (Y), magenta (M), cyan (C), and black (K) one atop the other. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus 100 includes, in a main body 50, a toner storage unit 7, an image forming unit 44, an exposure unit 45, a transfer device 46, a fixing device 47, a paper feed unit 48, a paper output unit 49, a controller, and so forth.

The toner storage unit 7 stores fresh toner of four different colors and is disposed at the upper portion of the main body 50. The toner storage unit 7 includes toner bottles 7Y, 7M, 7C, and 7K, each of which stores a different color of toner and supplies a predetermined amount of toner to a respective developing device through a supply device and a toner supply path.

The image forming unit 44 includes four process cartridges 5Y, 5M, 5C, and 5K, each of which produces a single-color toner image with a respective color of toner. The image forming unit 44 is disposed substantially in the center of the main body 50. The process cartridges 5Y, 5M, 5C, and 5K include photosensitive drums 1Y, 1M, 1C, and 1K, respectively, each of which serves as a latent image bearing member or also referred to as an image bearing member. The image forming unit 44 includes four process cartridges 5Y, 5M, 5C, and 5K, each of which produces a single-color toner image with a respective color of toner. The image forming unit 44 is disposed substantially in the center of the main body 50.

The exposure unit 45 writes an electrostatic latent image on each of the photosensitive drums 5Y, 5M, 5C, and 5K of the image forming unit 44. The exposure unit 45 is disposed substantially below the image forming unit 44. The exposure unit 45 includes a polygon motor and a light source such as a laser diode (LD). More specifically, the exposure unit 45 illuminates the photosensitive drums 1Y, 1M, 1C, and 1K with laser light from the light source and scans the surface by the polygon motor to expose the charged surface of the photosensitive drums 1Y, 1M, 1C, and 1K uniformly charged by a charging device. A surface potential of the photosensitive drums 1Y, 1M, 1C, and 1K is reduced partially to form an electrostatic latent image on the surface thereof.

The transfer device 46 serving as a transfer mechanism transfers a toner image formed by the image forming units 44 onto a recording medium P and is disposed above the image forming unit 44. The transfer device 46 includes an intermediate transfer belt 21, a drive roller 32, driven rollers 31 and 33, four primary transfer rollers 24Y, 24M, 24C, and 24K, a secondary transfer roller 25, and so forth. Devices of the transfer device 46 except the secondary transfer roller 25 constitute an intermediate transfer unit 20.

The intermediate transfer belt 21 is formed into an endless loop and serves as an intermediate transfer member. The intermediate transfer belt 21 is formed of a semiconductive elastic resin. The intermediate transfer belt 21 is entrained about and stretched taut at a certain tension between support rollers such as the driven rollers 31 and 33, and the drive roller 32. The drive roller 32 is connected to a drive motor via a drive transmission device such as a gear train. The drive roller 32 is rotated in the counterclockwise direction by the drive motor, and rotation of the drive roller 32 enables the intermediate transfer belt 21 to travel in a direction indicated by an arrow A.

The primary transfer rollers 24Y, 24C, 24M, 24K as a primary transfer mechanism primarily transfer the toner images formed on the photosensitive drums 1Y, 1C, 1M, and 1K onto the intermediate transfer belt 21 such that they are superimposed one atop the other, thereby forming a composite color toner image on the surface of the intermediate transfer belt 21. The primary transfer rollers 24Y, 24M, 24C, and 24K are disposed opposite the respective photosensitive drums 1Y, 1M, 1C, and 1K via the intermediate transfer belt 21, and rotated in accordance with rotation of the intermediate transfer belt 21 traveling in the direction of arrow A. A belt cleaning device 26 is disposed opposite the driven roller 33 via the intermediate transfer belt 21.

Each of the primary transfer rollers 24Y, 24M, 24C, and 24K is pressed against the respective photosensitive drums 1Y, 1M, 1C, and 1K from inside the looped intermediate transfer belt 21 by a moving device, thereby forming primary transfer nips. The primary transfer rollers 24Y, 24M, 24C, and 24K serve as contact-type transfer bias (transfer voltage) applicators connected to a bias power source. A primary transfer bias having a polarity opposite that of the toner image is applied to the intermediate transfer belt 21 from the back surface of the intermediate transfer belt 21. It is to be noted that as a transfer bias applicator a contact-free charging device may be employed. According to the present illustrative embodiment, the primary transfer roller employs one that produces few dust particles.

According to the present illustrative embodiment, the primary transfer rollers are pressed against the intermediate transfer belt by the moving device. Alternatively, a device that brings the primary transfer rollers to touch the intermediate transfer belt lightly may be employed.

The secondary transfer roller 25 is disposed at a position facing to the drive roller 32 via the intermediate transfer belt 21. The intermediate transfer belt 21, the secondary transfer roller 25, and the drive roller 32 constitute a secondary transfer portion 22. As illustrated in FIG. 2B, a shaft of the secondary transfer roller 25 is pressed against the drive roller 32 via the intermediate transfer belt 21 by a biasing member such as a spring 63 or the like of a moving device 60, thereby forming a secondary transfer nip. More specifically, the moving device 60 includes a cam 61, a bar 62, and the spring 63. The spring 63 is connected the shaft of the secondary transfer roller 25.

The secondary transfer roller 25 is connected to a bias power source and serves as a contact-type transfer bias applicator that applies a secondary transfer bias having a polarity opposite that of the toner. It is to be noted that the drive roller 32 may serve as the transfer bias applicator. In this case, the drive roller 32 applies a transfer bias having the same polarity as that of the toner image to be transferred.

The moving device 60 may employ any other suitable moving devices that can move the secondary transfer roller 25 to contact and separate from the drive roller 32 via the intermediate transfer belt 21. For example, such moving devices include, but are not limited to a pressing member such as a spring, a moving device using a cam and a lever such as proposed in JP-2009-288376-A, a moving device using a solenoid and a biasing member such as a spring.

An optical detector 30 is disposed above the intermediate transfer belt 21 near the drive roller 32. The optical detector 30 detects a position of each test pattern formed on the intermediate transfer belt 21 for detection of color drift.

The belt cleaning device 26 includes a brush roller and a cleaning blade. The brush roller applies a lubricating agent and removes toner residues remaining on the outer peripheral surface of the intermediate transfer belt 21 after transfer process, and the cleaning blade scrapes and collects the toner residues. The collected toner residues are transported from the belt cleaning device 26 to a waste toner bin by a transport device and discarded.

The fixing device 47 fixes a toner image which has been transferred on the recording medium P at the transfer device 46. The fixing device 47 is disposed above the transfer device 46. The fixing device 47 includes a pressing roller 47*b*, a fixing roller 47*a* equipped with a heater inside thereof as a heat generating member, and so forth. The pressing roller 47*b* is pressed against the fixing roller 47*a* by a biasing member so that the pressing roller 47*b* pressingly contacts the fixing roller 47*a*, thereby forming a fixing nip. The fixing roller 47*a* and the pressing roller 47*b* apply heat and pressure to the recording medium P being transported from the paper feed unit 48, thereby fixing the unfixed toner image which has been transferred onto the recording medium P at the transfer device 46.

The paper feed unit 48 feeds recording media sheets P having a predetermined size including but not limited to copying paper, a resin sheet (for example, an OHP sheet), and so forth. The recording medium P is not limited to paper, but may be a sheet-type medium of any kind. The paper feed unit 48 is disposed at the bottom of the main body 50. The paper feed unit 48 includes a paper cassette 29, a feed roller 27, a pair of registration rollers 28, and so forth. The paper cassette 29 accommodates multiple recording media P. The feed roller 27 sends the recording medium P to a sheet transport path one sheet at a time. The pair of registration roller 28 adjusts time of feeding the recording medium P to the secondary transfer nip. The feed roller 27 pressingly contacts the top sheet of the stack of recording media P in the paper cassette 29 to send the top sheet to the sheet transport path one sheet at a time based on a control signal provided by the controller.

The paper output unit 49 is formed at the upper portion of the main body 50 and accommodates the recording medium P on which an image is fixed by the fixing device 47. Multiple recording media sheets can be stacked on the paper output unit 49. The paper output unit 49 includes an output tray 38 formed on the upper surface of the main body 50, and a pair of output rollers 39 to output the recording medium P which has passed through the fixing device 47 onto the output tray 38.

A description will be given of the process cartridges 5Y, 5M, 5C, and 5K of the image forming apparatus 100. As described above, the image forming apparatus 100 includes four process cartridges 5Y, 5M, 5C, and 5K serving as image forming units arranged along the bottom surface of the intermediate transfer belt 21 in this order from the upstream side in the traveling direction of the intermediate transfer belt 21. The process cartridges 5Y, 5M, 5C, and 5K have the same configuration as all the other. Thus, the description is provided of the process cartridge 5Y for yellow color as a representative example of the process cartridges. In the present illustrative embodiment, the process cartridge 5Y is disposed at the extreme upstream end in the traveling direction of the intermediate transfer belt 21.

The process cartridge 5Y is detachably attachable relative to the main body 50 of the image forming apparatus 100, thereby allowing replacement of consumables at once. As illustrated in FIG. 1, the process cartridge 5Y includes the photosensitive drum 1Y, a charging device 2Y, a developing device 3Y, a cleaning device 4Y, and so forth. The charging device 2Y, the developing device 3Y, and the cleaning device 4Y are arranged around the photosensitive drum 1Y in this order from the upstream side in the direction of rotation of the photosensitive drum 1Y. Similarly, charging devices 2M, 2C, and 2K, developing devices 3M, 3C, and 3K, and cleaning devices 4M, 4C, and 4K are arranged in the same manner as the process cartridge 5Y.

The charging device 2Y charges uniformly the outer peripheral surface of the photosensitive drum 1Y with a predetermined polarity. The charging device 2Y includes a charging roller serving as a charging device to charge uniformly the outer peripheral surface of the photosensitive drum 1Y with the predetermined polarity.

The developing device 3Y develops an electrostatic latent image formed on the photosensitive drum 1Y with yellow toner to form a visible image, known as a toner image. The developing device 3Y is a two-component developing device of a two-axis conveyor type in which toner particles in a two-component developing agent consisting of toner and carrier particles are adhered to the electrostatic latent image on the photosensitive drum 1Y by a developing roller.

The cleaning device 4Y removes toner residues remaining on the photosensitive drum 1Y after the primary transfer. More specifically, the cleaning device 4Y includes a cleaning blade that contacts the photosensitive drum 1Y and scrapes off the toner residues adhered to the outer peripheral surface of the photosensitive drum 1Y after the primary transfer. The cleaning device 4Y also includes a toner residue container to store the toner residues and a conveyor screw to deliver the waste toner collected in the toner residue container to the waste toner bin.

Next, a description is provided of an image forming operation of the process cartridge.

First, the charging roller of the charging device 2Y charges uniformly the outer peripheral surface of the photosensitive drum 1Y with a predetermined polarity. Downstream from the charging device 2Y in the direction of rotation of the photosensitive drum 1Y, the exposure unit 45 illuminates the photosensitive drum 1Y with laser light indicated by a broken line based on image information, thereby reducing the surface potential of the illuminated portion of the photosensitive drum 1Y. Accordingly, the electrostatic latent image is formed on the surface of the photosensitive drum 1Y. Subsequently, the developing device 3Y supplies yellow toner to the electrostatic latent image to form a yellow toner image. The single-color toner image in yellow moves to the primary transfer nip in accordance with rotation of the photosensitive drum 1Y, and the primary transfer bias is applied thereto from the primary transfer roller 24Y, thereby transferring the toner image onto the intermediate transfer belt 21 using an electrostatic attractive force. Subsequently, the cleaning device 4Y removes toner residues remaining on the surface of the photosensitive drum 1Y after the primary transfer in preparation for the subsequent imaging cycle.

A description is now provided of the image forming operation of the image forming apparatus 100.

First, as described above, the single-color toner image in yellow is formed on the photosensitive drum 1Y in the process cartridge 5Y. Subsequently, the photosensitive drum 1Y is rotated to the primary transfer nip at which the transfer roller 24Y applies the primary transfer bias having a polarity opposite that of the toner to transfer the yellow toner image from the photosensitive drum 1Y to the intermediate transfer belt 21 using the electrostatic attractive force. Similarly, in other process cartridges 5M, 5C, and 5K, toner images in the respective colors are formed, and the toner images in magenta, cyan, and black are primarily transferred on top of the yellow toner image on the intermediate transfer belt 21 as the intermediate transfer belt 21 rotates. The toner images in yellow, magenta, cyan, and black are superimposed one atop the other on the intermediate transfer belt 21, thereby forming a composite (full color) toner image.

In the meantime, the feed roller 27 of the paper feed unit 48 feeds a recording medium P from the paper cassette 29 one sheet at a time. When the leading edge of the recording medium P arrives at the pair of the registration rollers 28 and a paper detector detects the recording medium P, rotation of the registration rollers 28 is stopped temporarily and then rotated again based on a detection signal provided by the paper detector to feed the recording medium P to the secondary transfer nip in appropriate timing. At the secondary transfer nip, the secondary transfer roller 25 applies the secondary transfer bias, thereby transferring the composite, full-color toner image from the intermediate transfer belt 21 onto the recording medium P by the electrostatic attractive force. Subsequently, the recording medium P bearing the unfixed toner image on the surface thereof is sent to the fixing nip of the fixing device 47 at which heat and pressure are applied to the recording medium and the unfixed toner image is fixed.

After the toner image is fixed on the recording medium P, the recording medium P is output onto the output tray 38 by the pair of output rollers 39 of the paper output unit 49. After the secondary transfer, the toner residues remaining on the intermediate transfer belt 21 is removed by the belt cleaning device 26 in preparation for the subsequent imaging cycle. The toner residues removed by the belt cleaning device 26 are delivered to the waste toner bin and discarded.

In order to facilitate an understanding of the novel features of the present disclosure, as a comparison a description is provided of a conventional color correction control.

Generally, in the known image forming apparatus as mentioned earlier, at least one of a pair of secondary transfer rollers (for example, a drive roller and a secondary transfer roller) employs an elastic roller such as a rubber roller to enhance transferability. In this configuration, the diameter of the roller changes slightly between when the roller is pressed against a recording medium via the intermediate transfer belt during transfer of an image and when the roller is separated such as when the test pattern is formed for the color drift adjustment. When the diameter of the roller changes, the surface speed of the intermediate transfer belt entrained about the drive roller or the like fluctuates, hence resulting in a registration deviation in actual printing.

To address this difficulty, in one example of the known correction, when detecting the test pattern for adjustment of color drift, the secondary transfer roller remains in contact with the intermediate transfer belt.

In another approach, the difference in the linear speed of the intermediate transfer belt between when the intermediate transfer belt is rotated at a constant speed by a feedback control regardless of changes in the diameter of the secondary transfer roller based on encoder information provided by an encoder of the intermediate transfer belt and when the color drift adjustment is performed without the feedback control is stored. Then, the difference in the speed is incorporated into a correction parameter so that the color drift caused by the movement of the secondary transfer roller is prevented without the feedback control.

Although advantageous, when the secondary transfer roller is in contact with the intermediate transfer belt and the test pattern for the detection passes therebetween, the secondary transfer roller gets contaminated, resulting in contamination of the recording medium when transferring an image and rubbing the test pattern.

Since an encoder detector that moves together with the intermediate transfer belt is necessary to perform the feedback control to obtain the difference in the speed, the control gets complicated and the cost increases. Furthermore, in recent years, a single drive source tends to drive multiple targets for the purpose of cost reduction. In such a configuration, the feedback control is easily disturbed, thus failing the control.

Embodiment 1

Figure 2A:
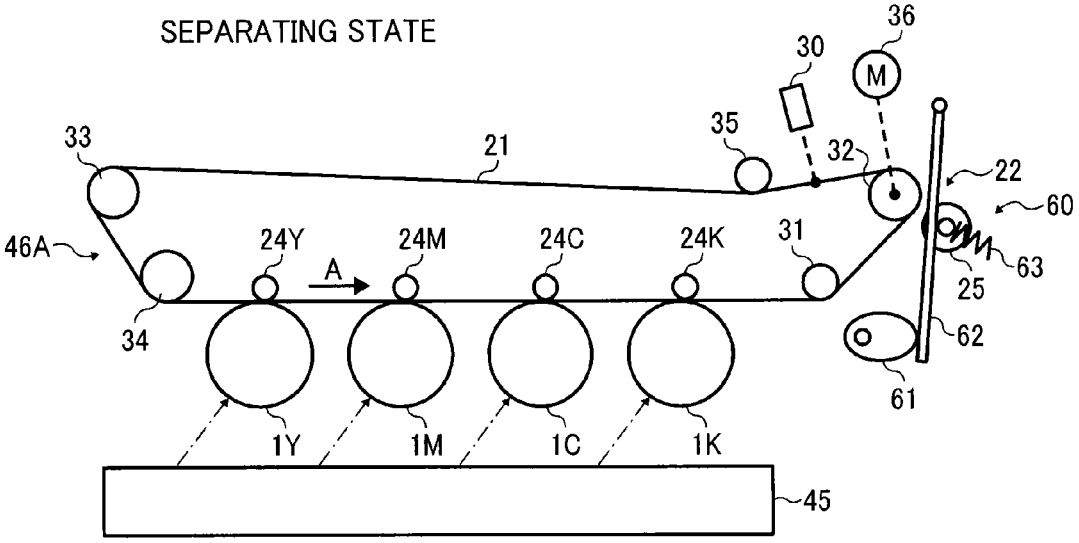
FIG. 2A is a schematic diagram illustrating a secondary transfer portion of the image forming apparatus of FIG. 1 in a separating state.
Figure 2B:
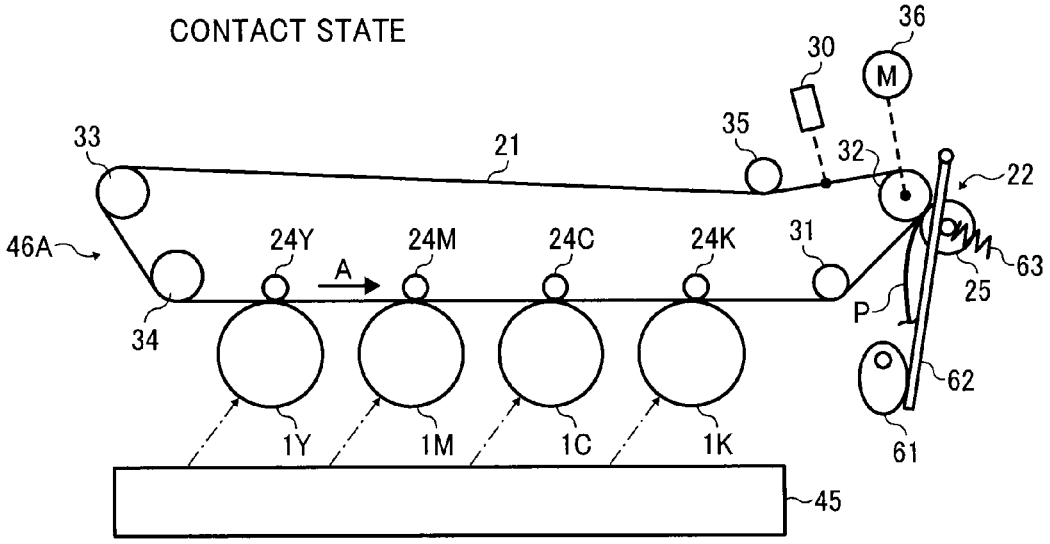
FIG. 2B is a schematic diagram illustrating the secondary transfer portion in a contact state.
Figure 3:
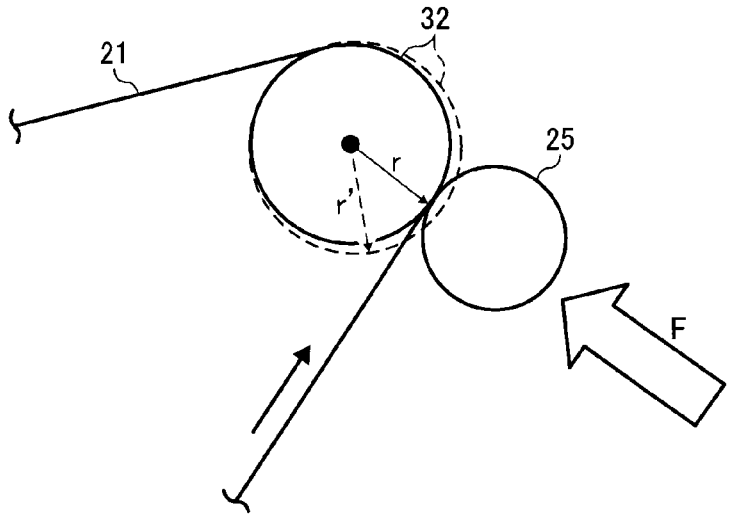
FIG. 3 is a cross-sectional view schematically illustrating a drive roller and a secondary transfer roller at the secondary transfer portion to explain a change in a diameter of the drive roller.
Figure 4:
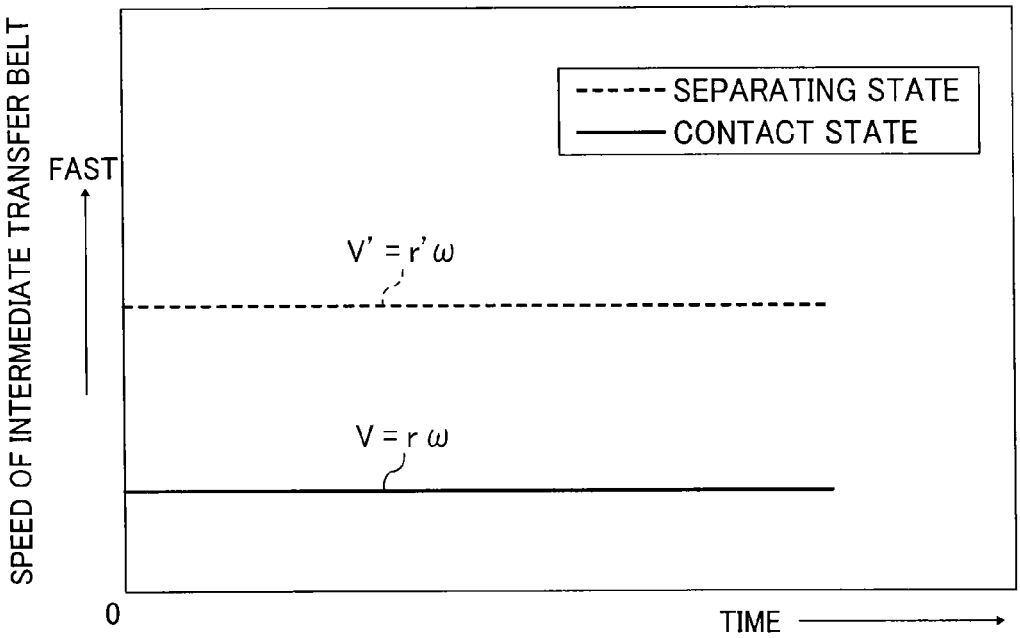
FIG. 4 is a graph showing a surface speed of an intermediate transfer belt when the drive roller is rotated at a constant speed.

With reference to FIGS. 2A through 4, a description is provided of a first illustrative embodiment of the present disclosure. FIG. 2A is a schematic diagram illustrating the secondary transfer portion 22 of the image forming apparatus in a separating state in which the secondary transfer roller 25 is separated from the intermediate transfer belt 21. FIG. 2B is a schematic diagram illustrating the secondary transfer portion 22 in a contact state in which the secondary transfer roller 25 is in contact with the intermediate transfer belt 21. FIG. 3 is a cross-sectional view schematically illustrating the drive roller 32 and the secondary transfer roller 25 at the secondary transfer portion 22. FIG. 4 is a graph showing a surface speed of the intermediate transfer belt 21 when the drive roller 32 is rotated at a constant speed.

The tandem-type image forming apparatus 100 is advantageous in that the productivity (for example, a number of sheets to be printed per unit time) is improved significantly. However, the positional accuracy and the diameter of the photosensitive drum 1 and the exposure unit 45, and the accuracy of optical system vary for each of image forming units. As a result, color drift occurs on the recording medium P, thus necessitating color drift control.

In the color drift control, test patterns are formed for each color on the intermediate transfer belt 21. The optical detector 30 detects the position of each test pattern formed on the intermediate transfer belt 21 for detection of color drift. Based on the detection result, the degree of color drift for each component is calculated. Each detector consists of a reflective-type photosensor that detects an intensity of reflected light reflected on the surface of the intermediate transfer belt 21 and the test patterns for each color. Based on the detection results, skew, a registration deviation in both main and sub-scanning directions (in this example, for black color), and a main-scanning magnification error are calculated. The amount of each deviation, the correction amount, and execution of correction are performed by a computing device of the controller.

The registration deviation in the main and the sub-scanning directions can be electrically corrected by adjusting the timing at which the exposure unit 45 starts writing. The main-scanning magnification is electrically corrected by adjusting the pixel clock. Correction methods of the skew of scan beam in the exposure unit 45 include a mechanical correction method and an image processing correction method in which an output image is deformed in a reverse direction and output. The mechanical correction method includes an adjustment mechanism to displace the mirror in the writing unit of the exposure unit 45 to correct the skew. In the image processing correction method, a portion of an image is stored in a line memory, and is read out while switching the read-out position, thereby correcting the skew between colors.

Similar to a generally-known secondary transfer portion, in the present illustrative embodiment, the secondary transfer portion 22 employs the secondary transfer roller 25 and the drive roller 32, both of which are made of rubber (elastic body) in consideration of transferability of the toner image onto a recording medium. The secondary transfer roller 25 and the drive roller 32, that is, the pair of rubber rollers, may be provided with the moving device 60 to enable the secondary transfer roller 25 and the drive roller 32 to separate from each other as shown in FIG. 2A and to contact each other as shown in FIG. 2B.

In the contact state, normally, upon transfer of the toner image onto the recording medium P, the secondary transfer roller 25 is pressed against the drive roller 32 via the intermediate transfer belt 21 by a spring or the like so as to secure the transferability when the toner image transferred on the intermediate transfer belt 21 is secondarily transferred onto a recording medium P. It is to be noted that in FIGS. 2A and 2B, the belt cleaning device 26 is not shown.

Figure 6:
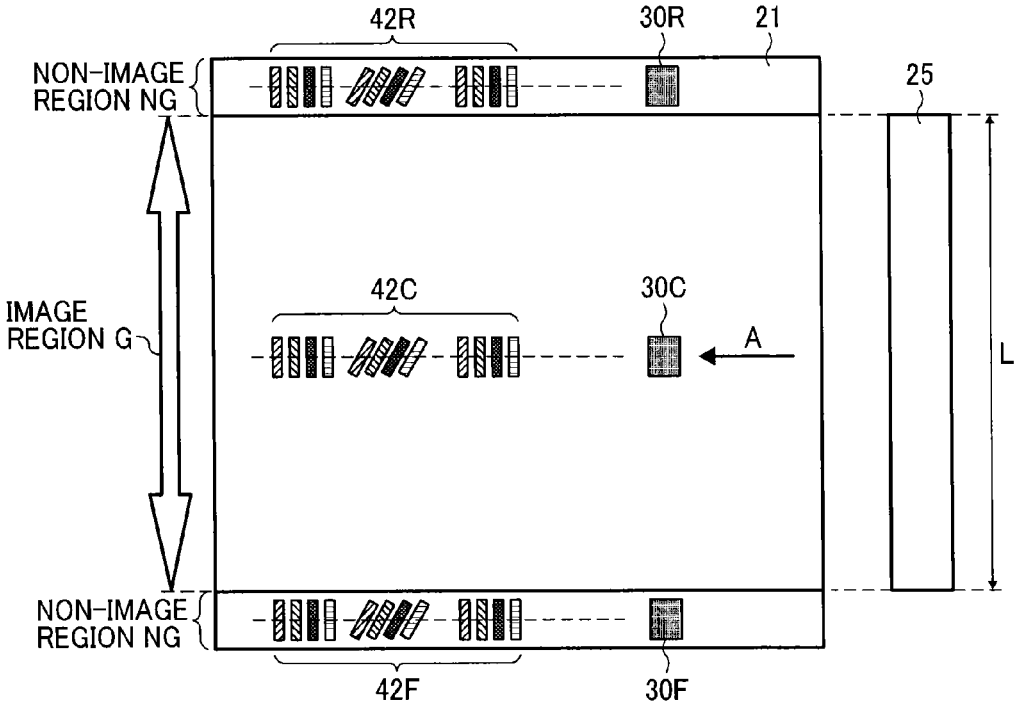
FIG. 6 is a plan view illustrating test patterns for correction of color drift formed on the intermediate transfer belt and an optical detector in the separating state.

The secondary transfer portion 22 takes the separating state for the following reason. When a test pattern 42C shown in FIG. 6 is in an image region G in the contact state of FIG. 2B, the test pattern 42C may get rubbed by the secondary transfer roller 25 at the secondary transfer portion 22, and the toner of the test pattern 42C may stick to the secondary transfer roller 25. As a result, the test pattern 42C is not detected correctly by the optical detector 30, and the toner adhered to the secondary transfer roller 25 moves to the rear surface of the recording medium P, contaminating the recording medium P. Furthermore, when the secondary transfer roller 25 is always in contact with the intermediate transfer belt 21, the surface of the pair of rubber rollers, that is, the secondary transfer roller 25 and the drive roller 32, deforms due to pressure of the spring or the like, hence changing the speed of the intermediate transfer belt 21.

As illustrated in FIG. 3, a radius r' of the drive roller 32 indicated by a broken line in the separating state and a radius r of the drive roller 32 indicated by a solid line in the contact state have a relation of $r'>r$. In the contact state, the radius of rotation is decreased slightly due to the pressure F. A drive motor 36 is controlled such that the number of revolutions of the drive motor 36 is constant based on a frequency generator (FG) signal (e.g., a speed detection signal) of a generally-known brushless motor. Thus, the angular velocity w of the drive roller 32 is constant.

As illustrated in FIG. 4, the surface speed V of the intermediate transfer belt 21 in the contact state and the surface speed V' of the intermediate transfer belt 21 in the separating state have the following relation: $V<V'$. More specifically, even when correction of the color drift is performed while the intermediate transfer belt 21 has the surface speed V' (separating state), the surface speed of the intermediate transfer belt 21 is V (contact state) when actually transferring the image onto the recording medium P. Therefore, there is a difference in the surface speed of the intermediate transfer belt 21 between the contact state and the separating state, and this difference in the surface speed appears as a registration deviation.

Frequency generator (FG) control is common in a speed detection mechanism of the brushless motor. In the FG control, the speed of rotation is obtained based on the FG signal at a frequency proportional to the speed of rotation generated by an FG pattern due to rotation of a rotor. The FG pattern is serially connected on the stator side of the motor in the circumferential direction. Based on the information thus obtained, the speed of rotation of the rotor is controlled to be constant. That is, it is a feed-back control that completes within the motor.

To address the difficulty as mentioned above, in the known art, a deformation-resistant intermediate transfer belt and a driven roller made of metal which is not easily deformed by the pressure of the secondary transfer roller are employed. The driven roller includes an encoder, and the intermediate transfer belt includes slit-shaped patterns, thereby detecting the speed. With this configuration, the feedback control is employed to make the surface speed of the intermediate transfer belt constant. However, to realize cost reduction, there is increasing demand for a single drive source capable of driving a plurality of drive targets (for example, the intermediate transfer belt 21 and the photosensitive drum 1), except for high-end devices such as a high quality device for offset printing and a high-speed device requiring high torque. Thus, performing the feedback control increases deviations and disturbances relative to the drive targets other than the intermediate transfer belt 21, thereby complicating the control and failing the control due to geometric problems. The speed detector may also be subjected to the cost reduction.

When correcting the color drift in the contact state, the optical detector 30 may be disposed upstream from the secondary transfer portion 22 and the secondary transfer roller 25 may be provided with a cleaning device. This configuration may enable the correction of the color drift in the contact state. In terms of a geometric perspective, however, there is not much freedom in arrangement of the optical detector 30. It is difficult to place the optical detector 30 upstream from the secondary transfer portion 22 without limitations in the arrangement. Adding the cleaning device increases the cost.

In view of the above, according to the present illustrative embodiment of the present disclosure, the color drift is corrected without being affected by the difference between the surface speed V of the intermediate transfer belt 21 in the contact state and the surface speed V' in the separating state.

Figure 5:
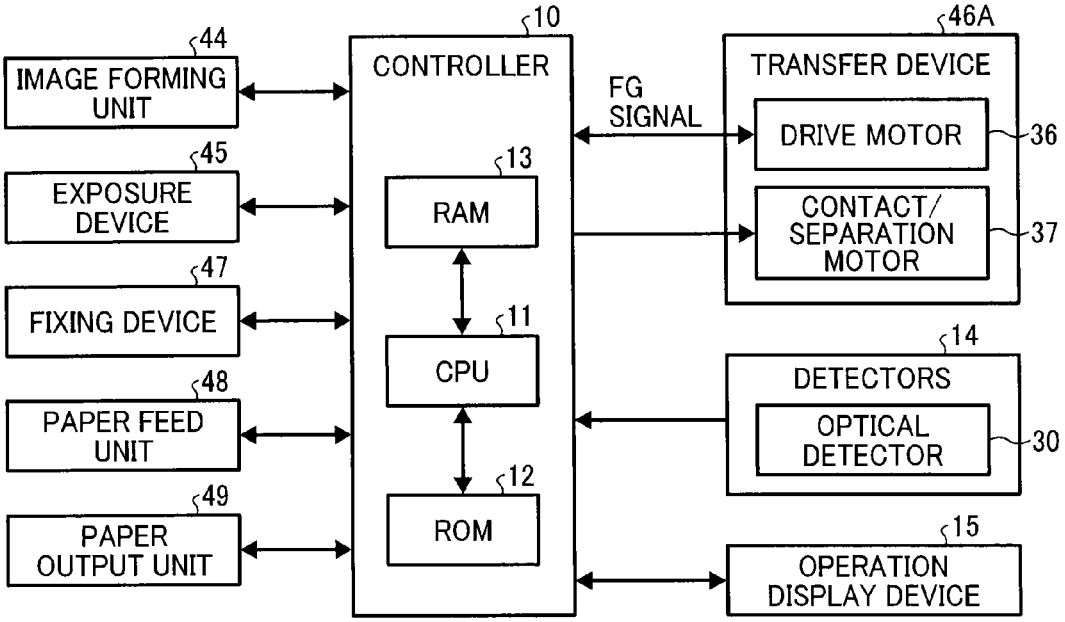
FIG. 5 is a block diagram showing a control of a first illustrative embodiment of the present disclosure.

According the first illustrative embodiment, instead of using the transfer device 46, a transfer device 46A shown in FIGS. 2 and 3 and a controller 10 shown in FIG. 5 are employed to correct the color drift. The same configuration as that shown in FIG. 1 is employed except the transfer device 46A and the controller 10 in the present illustrative embodiment.

As compared with the transfer device 46, as illustrated in FIG. 2, the transfer device 46A includes a driven roller 34 and a tension roller 35 and the drive motor 36 as a drive source that drives the drive roller 32 is a generally-known brushless DC motor. Furthermore, the transfer device 46A does not include a speed detector such as an encoder.

The drive roller 32 is connected to the drive motor 36 via the power transmission device such as a gear train.

In the present illustrative embodiment, the optical detector 30 is disposed above the intermediate transfer belt 21 near the drive roller 32 to detect the test pattern on the intermediate transfer belt 21 for detection of the color drift for each color. The optical detector 30 serves as a detector that detects the color drift of the toner image borne on the intermediate transfer belt 21. More specifically, as illustrated in FIG. 6, optical detectors 30F, 30C, and 30R are arranged to correspond to test patterns 42F, 42C, and 42R, respectively. According to the present illustrative embodiment, the optical detectors 30F, 30C, and 30R are collectively referred to as the optical detector 30.

The detection of the test pattern may simply be referred to as "pattern detection". In the present illustrative embodiment, the main-scanning direction refers to an axial direction (longitudinal direction) of a rotary shaft of the photosensitive drum 1. The sub-scanning direction refers to a direction of rotation of the photosensitive drum 1.

According to the present illustrative embodiment, the image forming apparatus includes the moving device 60 that enables the secondary transfer roller 25 to contact and separate from the drive roller 32 via the intermediate transfer belt 21. The moving device 60 may employ a known moving device using a pressing device such as a spring, and a moving device using a cam and a lever such as proposed in JP-2009-288376-A. As illustrated in FIG. 5, a contact/separation motor 37 serving as a driving device is employed to drive the cam 61 of the moving device 60.

With reference to FIG. 5, a description is provided of a control mechanism according to the first illustrative embodiment of the present disclosure. FIG. 5 is a block diagram showing the control mechanism. The image forming apparatus 100 of the present illustrative embodiment includes the controller 10 which is responsible for overall control of the image forming apparatus. The controller 10 includes a central processing unit (CPU) 11 and an information storage device. The CPU 11 is equipped with a computing mechanism and a control mechanism. A Random Access Memory (RAM) 13 including a nonvolatile RAM storing data, a Read Only Memory (ROM) 12, and a Hard Disk Drive (HDD), and so forth constitute the information storage device. According to the present illustrative embodiment, the ROM 12 stores various control programs required for an operating system, and a coping, facsimile, and printing processing, a Page Description Language (PDL) system of a printer, default settings of the system, and so forth.

The CPU 11 controls, via the information storage device, the driving devices for each device in the image forming apparatus 100 mentioned above and a liquid crystal display unit of an operation display device 15, based on signals from detectors 14 and signals set by various keys of the operation display device 15 in the image forming apparatus 100. The detectors 14 include the optical detector 30 as a representative example of the detectors.

As illustrated in FIG. 5, the driving devices include a motor and a solenoid for the image forming unit 44, the exposure unit 45, the drive motor 36 of the transfer device 46A, the contact/separation motor 37 of the moving device, the fixing device 47, the paper feed unit 48, and the paper output unit 49.

According to the present illustrative embodiment, the CPU 11 serves as a test pattern forming device for forming a test pattern for detection of the color drift and a color drift correction device for correction of the color drift in the separating state in which the intermediate transfer belt 21 and the secondary transfer roller 25 are separated. More specifically, immediately after correcting the color drift in the separating state, the CPU 11 forms the test pattern again when the secondary transfer roller 25 contacts the intermediate transfer belt 21 but not in such a manner that the secondary transfer roller 25 presses against the intermediate transfer belt 21, and the CPU 11 corrects the color drift while the secondary transfer roller 25 is in contact with the intermediate transfer belt 21.

The information on each detector and the counter information on the number of prints managed by the CPU 11 are stored in the RAM 13 on a periodic basis. The ROM 12 stores various control programs to enable the test pattern forming device and the color drift correction device, a program shown in a later-described flowchart, and associated data.

Figure 7:
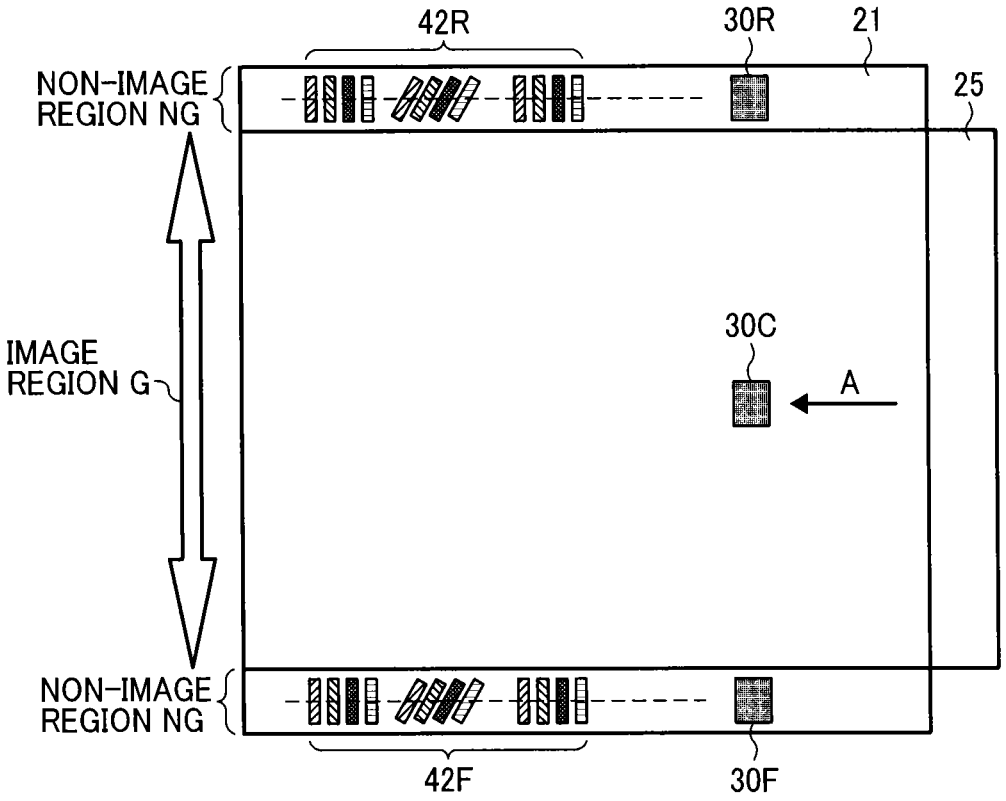
FIG. 7 is a plan view illustrating test patterns formed on the intermediate transfer belt for correction of color drift and the optical detector in the contact state.

With reference to FIGS. 6 and 7, a description is provided of arrangement of the optical detectors 30R, 30C, and 30F, and the test patterns used for correction of the color drift in the separation state and the contact state of the secondary transfer portion. FIG. 6 is a plan view illustrating the optical detectors 30 and the test patterns formed on the intermediate transfer belt 21 for correction of the color drift in the separating state. FIG. 7 is a plan view illustrating the optical detectors 30 and the test patterns formed on the intermediate transfer belt 21 for correction of the color drift in the contact state.

As illustrated in FIG. 6, in the separating state, the test patterns 42F, 42C, and 42R are formed and detected to correct the registration in the main-scanning direction and the sub-scanning direction, a magnification and the skew in the main-scanning direction. In accordance with a command from the CPU 11, the exposure unit 45, the image forming unit 44, and the transfer device 46A are driven.

In order to read accurately an amount by which the skew is corrected, the optical detectors 30F, 30C, and 30R are arranged to correspond to the test patterns 42F, 42C, and 42R, respectively, as precisely as possible, and read and calculate the test patterns to achieve higher detection accuracy. The test patterns 42F, 42C, and 42R are formed at both ends and in the center of the intermediate transfer belt 21. The difference between the surface speed V and the surface speed V' of the intermediate transfer belt 21 shown in FIG. 4 does not affect calculation of the amount of skew. Therefore, correction of the color drift is performed in the separating state.

In FIGS. 6 and 7, an image region G refers to a region in which the toner image is transferred and formed in the contact state in which the secondary transfer roller 25 is pressed against the intermediate transfer belt 21. Therefore, the width (length) of the image region G in the direction perpendicular to the traveling direction of the intermediate transfer belt 21 indicated by the arrow A coincides with the roller width (length) L of a rotary shaft of the secondary transfer roller 25. Furthermore, a non-image region NG, in which no toner image is transferred and formed in the contact state, is provided at both ends of the intermediate transfer belt 21.

Each of the test patterns 42F, 42C, and 42R consists of three sets (an upstream set, a downstream set, and a middle set) of four thick line patterns in yellow, black, magenta, and cyan in this order from the upstream side to the downstream side in the traveling direction A of the intermediate transfer belt 21, and each set of the test patterns 42F, 42C, and 42R is formed with a predetermined interval between each other. More specifically, the upstream set and the downstream set of the test patterns 42F, 42C, and 42R at the upstream side and the downstream side consist of line patterns parallel to the width direction. The middle set of the test patterns 42F, 42C, and 42R between the upstream set and the downstream set consists of line patterns extending diagonally to the upper right.

It is to be noted that since the four line patterns in four different colors in each set of the test patterns 42F, 42C, and 42R in the drawings are expressed in black and white, the color differentiation is done with changing directions of hatching in the drawings. More specifically, a horizontal hatching is used for the line in yellow in the test pattern. The solid line in black is for black. The diagonal hatching from lower right to top left is used for the line in magenta in the test pattern. The diagonal hatching from lower left to top right, which is opposite that of magenta, is used for the line in cyan in the test pattern.

The lines are arranged in the order of yellow, black, magenta, and cyan in the test patterns 42F, 42C, and 42R for the following reason. The position of the process cartridges 5Y for yellow and 5M for magenta are placed at a distant from the process cartridge 5B for the black color which is a base color. Thus, by forming the line patterns in yellow and magenta near black, reading error can be minimized.

According to the present illustrative embodiment, the process cartridges 5Y, 5M, 5C, and 5K constituting the image forming unit 44 including the photosensitive drums 1 are arranged in this order in the image forming apparatus 100. However, the order of arrangement is not limited thereto depending on the machine types. Depending on the machine types, the process cartridges may be arranged in the order from yellow (5Y), cyan (5C), magenta (5M), and black (5K), and in this case the order of line patterns of the test pattern is changed, accordingly.

As illustrated in FIG. 7, immediately after correction of the color drift in the separating state, the secondary transfer roller 25 contacts the intermediate transfer belt 21. Subsequently, the test patterns 42F and 42R are formed at two places outside the image region G and the non-image region NG at which the secondary transfer roller 25 does not contact the intermediate transfer belt 21. The registration deviation influenced by the difference between the surface speed V and the surface speed V' of the intermediate transfer belt 21 is detected and corrected. Although the end portions do not contact completely, considering the range of contact region the difference in the speed of the test patterns 42F, 42C, and 42R is insignificant as compared with the difference between the surface speed V and the surface speed V'. In this configuration, the color drift is corrected both in the separating state and in the contact state continuously to reduce or cancel the effect of the difference in the speed, thereby correcting all the components such as registration, magnification, skew, and so forth. More specifically, among the amount of correction of components, the amount of correction of the registration and the magnification (or only the registration) performed in the separating state may be rewritten with the amount of correction in the contact state (i.e., the surface speed V of the intermediate transfer belt 21).

Figure 8:
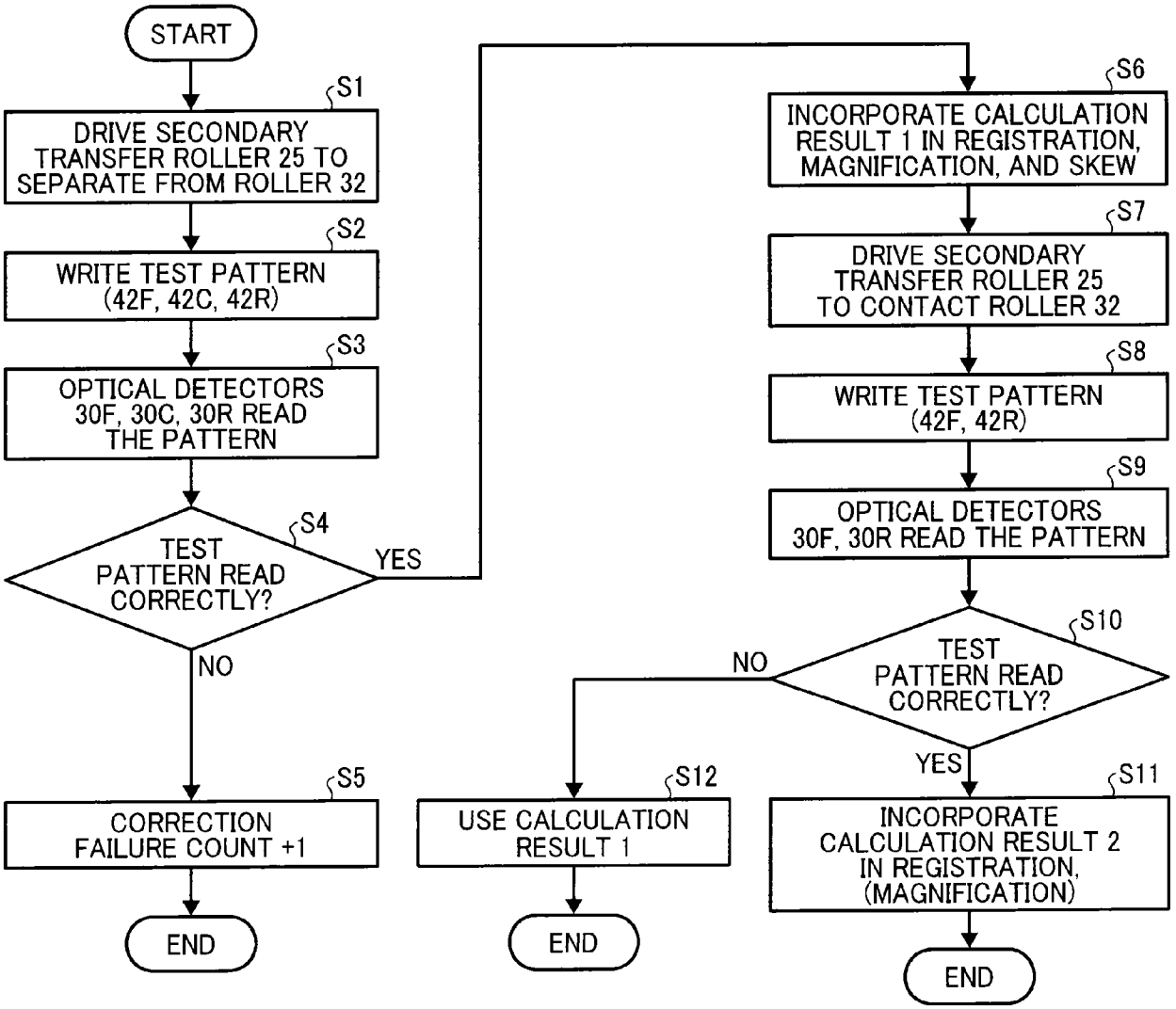
FIG. 8 is a flowchart showing steps in a normal correction according to the first illustrative embodiment of the present disclosure.

With reference to FIG. 8, a description is provided of operation steps. FIG. 8 is a flowchart showing steps in a normal correction according to the first illustrative embodiment of the present disclosure. The color drift is corrected in the separating state at steps S1 through S6. At steps S1 through S2, the secondary transfer roller 25 is separated from the drive roller 32 via the intermediate transfer belt 21, and subsequently, the test patterns 42F, 42C, and 42R are written/formed in the image region G and the non-image region NG of the intermediate transfer belt 21. Subsequently, at step S3, the optical detectors 30F, 30C, and 30R read and detect the respective test patterns 42F, 42C, and 42R.

Next, at step S4, whether or not the test patterns 42F, 42C, and 42R are read correctly is determined. In a case in which the test patterns are not read correctly, the flow advances to step S5 at which the operation finishes with a correction failure count +1. By contrast, in a case in which the test patterns are read successfully, the flow advances to step S6 at which the result is incorporated as a calculation result 1 into the write-start timing, the pixel clock, an angle of writing mirror, and so forth, that is, the registration, magnification and skew.

Subsequently, the color drift is corrected in the contact state at steps S7 through S11. At steps S7 through S8, the secondary transfer roller 25 is moved to contact the drive roller 32 via the intermediate transfer belt 21, and subsequently, the test patterns 42F and 42R are written/formed in the non-image region NG of the intermediate transfer belt 21. Subsequently, at step S9, the optical detectors 30F and 30R read and detect the respective test patterns 42F and 42R.

Next, at step S10, whether or not the test patterns 42F and 42R are read correctly is determined. In a case in which the test patterns are read successfully, the flow advances to step S11 at which the result is incorporated as a calculation result 2 and the calculation result 1 of the write-start timing and a feedback amount of the pixel clock are rewritten. That is, the result is provided to the registration (and the magnification) at step S11. With this configuration, correction calculation of the registration and magnification in the separating state (i.e., the surface speed V' of the intermediate transfer belt 21), which was performed conventionally, can be omitted, thereby preventing the color drift derived from the difference in the speed of the intermediate transfer belt 21.

In a case in which there is an error in reading the test patterns due to contact for some reasons and hence the result is "NO" at step S10 (mainly when the test patterns are blur and the level of light reflectance is low), the amount of feedback of the calculation result 1 is used at step S12. In this case, the registration deviation is included due to the difference between the surface speed V and the surface speed V' of the intermediate transfer belt 21, but the event probability is relatively low.

Figure 9:
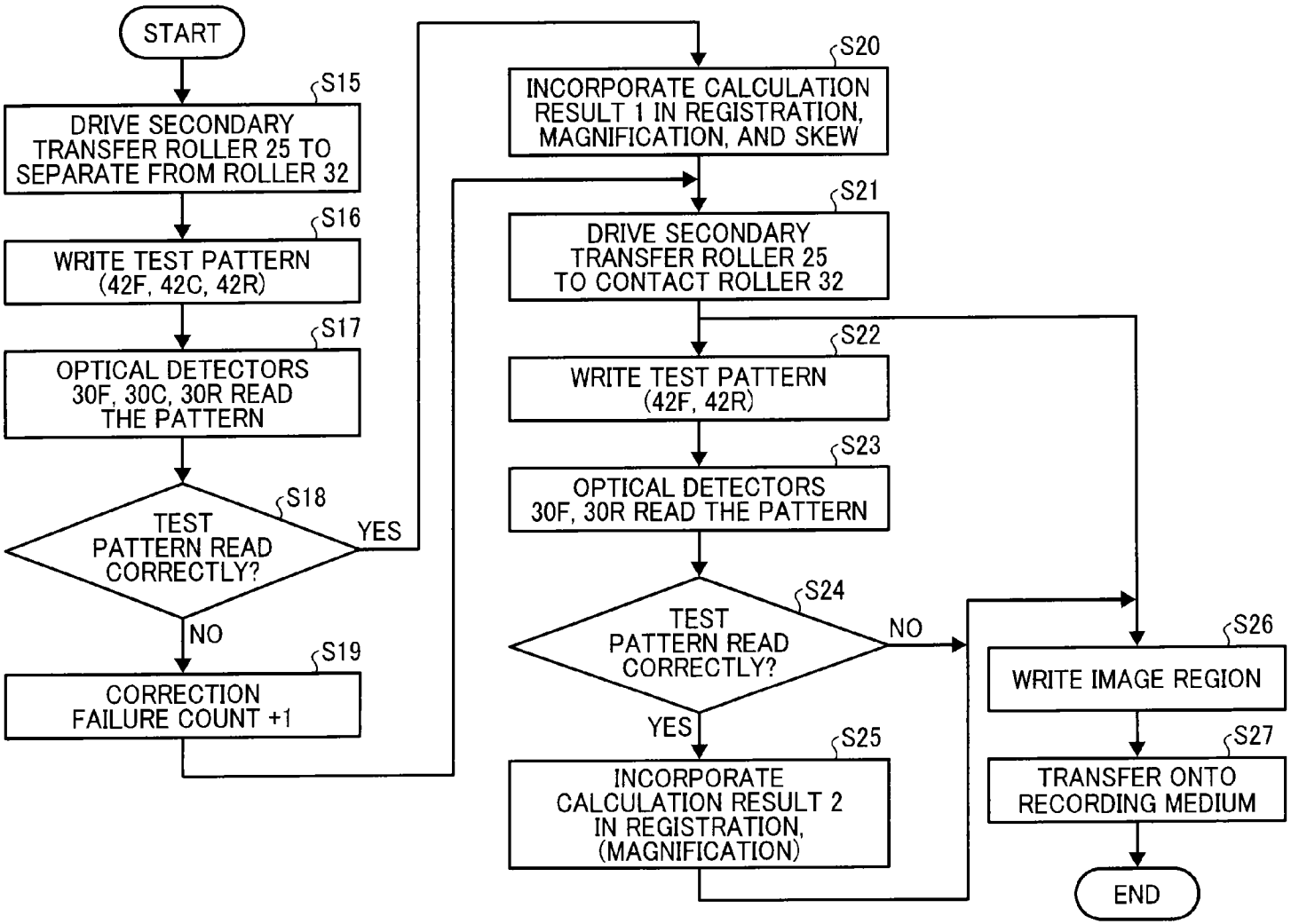
FIG. 9 is a flowchart showing steps in a correction different from the steps in FIG. 8 according to the first illustrative embodiment of the present disclosure.

With reference to FIG. 9, a description is provided of operation steps different from the steps shown in FIG. 8. FIG. 9 is a flowchart showing steps in the correction during conveyance of the recording medium P. The flow starts from step S15 in FIG. 9. The operations of the steps S15 through S18 and step S20 are the same as steps S1 through S6. The difference is that in a case in which the test patterns are not read correctly at step S18 (NO at S18), the flow advances to step S21 with a correction failure count +1.

The operations of the steps S21 through S25 are the same as steps S7 through S11 shown in FIG. 8. The operation branching from step S21, the operation when the test patterns are not read correctly at step S24, and the operations at steps S26 and S27 after step S25 are different from the operations shown in FIG. 8.

That is, in the correction of the color drift in the contact state, the test patterns are formed outside the image region of the intermediate transfer belt 21 relative to the recording medium P so that the calculation can be performed while an image is output if output of the image is instructed by a user. With this configuration, downtime can be reduced. In this case, the calculation result 1 is provided, and after the secondary transfer roller 25 contracts the intermediate transfer belt 21 the test patterns 42F and 42R are written and detected while the image pattern of the output image is written. However, in this flow shown in FIG. 9, the output image may contain the registration deviation derived from the difference between the surface speed V and the surface speed V' of the intermediate transfer belt 21 until the calculation result is reflected.

As described above, according to the present illustrative embodiment, the difference in the surface speed of the intermediate transfer belt 21 between the separating state and the contact state of the drive roller and the secondary transfer roller via the intermediate transfer belt is canceled, thereby controlling color alignment more accurately. With this configuration, the registration deviation derived from the difference in the speed of the intermediate transfer belt between the contact state and the separating state of the secondary transfer roller and the intermediate transfer belt can be corrected and suppressed at low cost with a simple control. The quality of an image is enhanced.

Embodiment 2

Figure 10:
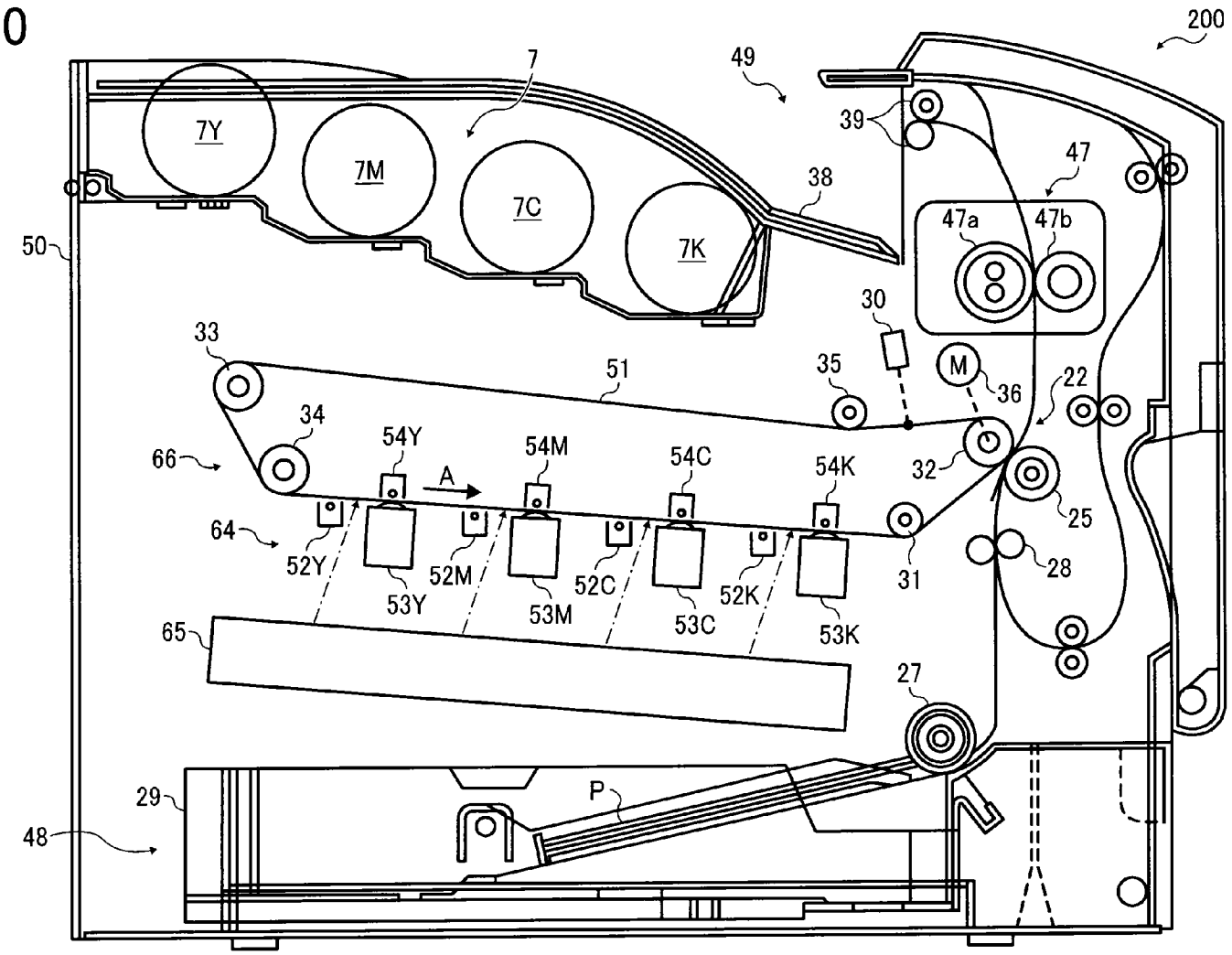
FIG. 10 is a schematic diagram illustrating an image forming apparatus according to another illustrative embodiment of the present disclosure.

With reference to FIG. 10, a description is provided of another illustrative embodiment of the present disclosure. FIG. 10 is a schematic diagram illustrating an image forming apparatus according to a second illustrative embodiment of the present disclosure. FIG. 10 shows a color image forming apparatus 200 of a four-tandem system as an example of an image forming apparatus of a second illustrative embodiment of the present disclosure. In the image forming apparatus 200, the parts that are the same as those shown in the previously described figures are given the same reference numbers and the descriptions thereof are omitted unless otherwise specified. The image forming apparatus 200 forms a color image using toners in four different colors: yellow (Y), magenta (M), cyan (C), and black (K).

According to the second illustrative embodiment of the present disclosure, as compared with the first illustrative embodiment, a photosensitive belt 51 is used in place of the intermediate transfer belt 21, an image forming unit 64 is used in place of the image forming unit 44, an exposure unit 65 is used in place of the exposure unit 45, and a transfer device 66 is used in place of the transfer device 46A. The configurations not mentioned above are similar to or the same as the first illustrative embodiment.

The photosensitive belt 51 is a belt type photoconductor formed into an endless looped belt. The image forming apparatus 200 includes the toner storage unit 7, the image forming unit 64, the exposure unit 65, the transfer device 66, the paper feed unit 48, the paper output unit 49 and the controller. The image forming apparatus 200 includes four image forming stations arranged from left to right below the photosensitive belt 51. Each of the image forming stations forms an image with a respective color of toner.

The image forming apparatus includes the endless-looped photosensitive belt 51 serving as an image bearing member. Chargers 52Y, 52M, 52C, and 52K as charging mechanisms, the exposure unit 65 as an exposure mechanisms, developing devices 53Y for yellow, 53M for magenta, 53C for cyan, and 53K for black as development mechanisms, and so forth are disposed around the photosensitive belt 51. Similar to the transfer device 46A of the first illustrative embodiment, the photosensitive belt 51 is entrained around the driven rollers 31, 33, and 34, and the drive roller 32, and stretched taut at a predetermined tension. The photosensitive belt 51 is driven to travel in the direction of arrow A by the drive motor 36.

A cleaning device equipped with a cleaning blade is provided to the photosensitive belt 51 opposite the driven roller 33 to clean the photosensitive belt 51.

When forming a full-color image, the surface of the photosensitive belt 51 is charged uniformly by the chargers 52Y, 52M, 52C, and 52K. Subsequently, the exposure unit 65 illuminates the surface of the photosensitive belt 51 with exposure light such as a laser beam based on image information, thereby forming an electrostatic latent image on the charged surface of the photosensitive belt 51. The electrostatic latent images formed on the photosensitive belt 51 are developed with respective color of toner by the developing devices 53Y, 53M, 53C, and 53K into visible images, known as toner images.

The primary transfer bias is applied to contact-free primary transfer electrodes 54Y, 54M, 54C, and 54K serving as primary transfer devices via the power source and a primary transfer current applicator at a toner-image transfer portion of each of the image forming units. Accordingly, the toner images in different colors are transferred onto the photosensitive belt 51 traveling in the direction of arrow A in FIG. 10 such that they are superimposed one atop the other, thereby forming a composite color toner image on the photosensitive belt 51.

Similar to the first illustrative embodiment, the recording medium P is picked up and supplied to the pair of registration rollers 28 by the feed roller 27 of the paper feed unit 48, and the pair of registration rollers 28 stops the leading end of the recording medium P temporarily to adjust alignment of the recording medium P. Subsequently, the recording medium P is fed from the pair of registration rollers 28 in appropriate timing at which the leading edge of the composite image on the photosensitive belt 51 arrives at the secondary transfer position. The composite toner image on the photosensitive belt 51 is transferred onto the recording P at the secondary transfer portion 22. More specifically, the composite toner image on the photosensitive belt 51 is transferred onto the recording P by the secondary transfer roller 25 to which a predetermined voltage is applied by the power source and the secondary transfer current applicator.

After the composite toner image is transferred onto the recording medium P and electrical charges of the recording medium P are removed, the recording medium P is delivered to the fixing device 47 at which heat and pressure are applied to the composite toner image on the recording medium P and the composite toner image is fixed on the recording medium P. After fixation of the composite toner image, the recording medium P is output onto the output tray 38 by the pair of output rollers 39. Subsequently, the cleaning device disposed near the driven roller 33 removes toner residues remaining on the surface of the photosensitive belt 51 after transfer in preparation for the subsequent imaging cycle. The toner residues removed by the cleaning device are delivered to a waste toner bin and discarded.

Still referring to FIG. 10, each of the primary transfer electrodes 54Y, 54M, 54C, and 54K are disposed inside the loop formed by the photosensitive belt 51 without contacting the photosensitive belt 51 and opposite to the developing devices 53Y, 53M, 53C, and 53K, respectively. A predetermined transfer bias is applied to the primary transfer electrodes 54Y, 54M, 54C, and 54K by the power source and the primary transfer current applicator.

The photosensitive belt 51 includes a conductive layer formed of polyethylene terephthalate (PET), and a photosensitizing agent is applied to the conductive layer.

The configurations and operations including the above-described control can be performed using the photosensitive belt 51 in place of the intermediate transfer belt 21 of the first illustrative embodiment by those skilled in the art. Thus, the detailed description is omitted.

It is obvious for those skilled in the art that the image forming apparatus 200 of the second illustrative embodiment can also perform the same control as in the first illustrative embodiment. As described above, according to the present illustrative embodiment, the difference in the speed of the photosensitive belt 51 between the separating state and the contact state of the drive roller and the secondary transfer roller via the photosensitive belt is canceled, thereby controlling color alignment more accurately. With this configuration, the registration deviation derived from the difference in the speed of the photosensitive belt between the contact state and the separating state of the secondary transfer roller and the photosensitive belt can be corrected and suppressed at low cost with a simple control. The quality of an image is enhanced.

Although the embodiment of the present invention has been described above, the present disclosure is not limited to the foregoing embodiments, but a variety of modifications can naturally be made within the scope of the present invention.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear a latent image on a surface thereof;

a plurality of developing devices disposed corresponding to the image bearing member to develop latent images formed on the image bearing member with toner in different colors to form toner images in different colors;

a transfer device to transfer the toner images from the image bearing member onto a recording medium;

a moving device to move the transfer device to contact the image bearing member in a contact state and separate from the image bearing member in a separating state;

a color drift detector to detect color drift of the toner images borne on the image bearing members;

a test pattern forming device to form a test pattern on the image bearing member to detect the color drift; and a color drift correction device to correct the color drift in the separating state in which the image bearing member and the transfer device are separated from each other;

the test pattern forming device forming the test pattern again in an area on the image bearing member contacting the transfer device but not pressed by the transfer device after the color drift correction device corrects the color drift in the separating state, and the color drift correction device correcting the color drift in the contact state in which the image bearing member and the transfer device are in contact with each other.

2. The image forming apparatus according to claim 1, further comprising a drive source to drive the image bearing member using a frequency generator (FG) signal.

3. The image forming apparatus according to claim 1, wherein while the test pattern is formed in the contact state after correction of the color drift in the separating state, an image, output of which is instructed by a user, is formed in a contact region of the image bearing member that contacts the transfer device.

4. The image forming apparatus according to claim 1, wherein the image bearing member is a belt-type intermediate transfer member formed into an endless loop.

5. The image forming apparatus according to claim 1, wherein the image bearing member is a belt-type photoconductor formed into an endless loop.

6. A method for correcting color drift, comprising the steps of:

separating a transfer device from an image bearing member;

writing a first test pattern for detection of color drift in an image region and a non-image region of an image bearing member in a separating state in which the transfer device is separated from the image bearing member;

detecting the first test pattern;

incorporating a result of the detecting of the first test pattern as a first calculation result into settings of registration, magnification, and skew when the first test pattern is detected correctly;

moving the transfer device to contact the image bearing member;

writing a second test pattern in the non-image region of the image bearing member;

detecting the second test pattern; and incorporating a result of the detecting of the second test pattern as a second calculation result in the settings of registration and magnification when the second test pattern is detected correctly.

* * * * *